US006371624B1

(12) United States Patent
Dorney

(10) Patent No.: US 6,371,624 B1
(45) Date of Patent: Apr. 16, 2002

(54) GLOW CUP MODULAR SYSTEM

(76) Inventor: Peter Dorney, 1590 Dalton Dr., Oviedo, FL (US) 32765

( * ) Notice: Subject to any disclaimer, the term of this patent is extended or adjusted under 35 U.S.C. 154(b) by 0 days.

(21) Appl. No.: 09/778,981

(22) Filed: Feb. 7, 2001

(51) Int. Cl.[7] ..... F21K 2/00

(52) U.S. Cl. ..... 362/34; 362/101; 362/562; 362/154; 362/84

(58) Field of Search ..... 362/34, 562, 101, 362/154, 84

(56) References Cited

U.S. PATENT DOCUMENTS 5,671,998 A * 9/1997 Collet ..... 362/101

6,062,380 A * 5/2000 Dorney ..... 362/34

* cited by examiner

*Primary Examiner*—Stephen Husar
*Assistant Examiner*—Guiyoung Lee

(57) ABSTRACT

A glow cup modular system comprising a generally rigid exterior member that has a side wall with a top edge and a bottom edge to form an upper cavity for receiving and retaining a beverage container. The exterior member further has a circular planar surface located at an intermediate height. The system also includes a interior member that has a side wall with a planar top surface at the top end and has a recessed portion extending downward from the center of the planar top and fabricated of a pliable material. The generally rigid interior member also has a bottom end with a horizontal lip coupled to the horizontal lip of the exterior member form an air tight intermediate gap is formed between the two members.

8 Claims, 3 Drawing Sheets

FIG 3
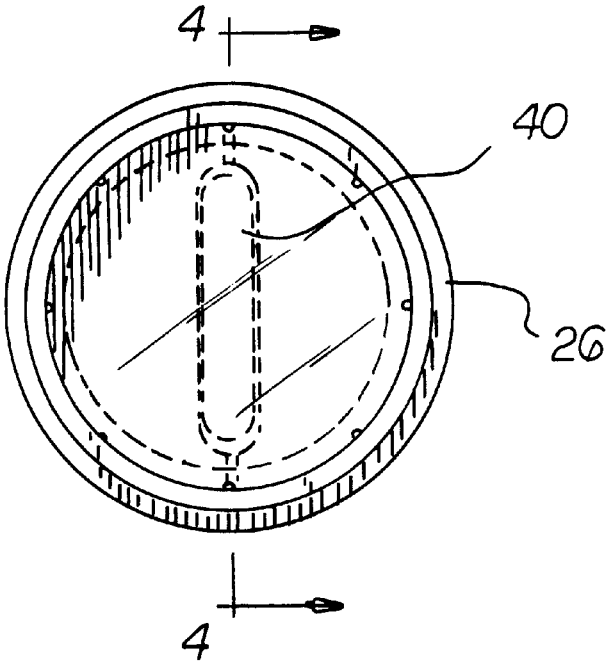
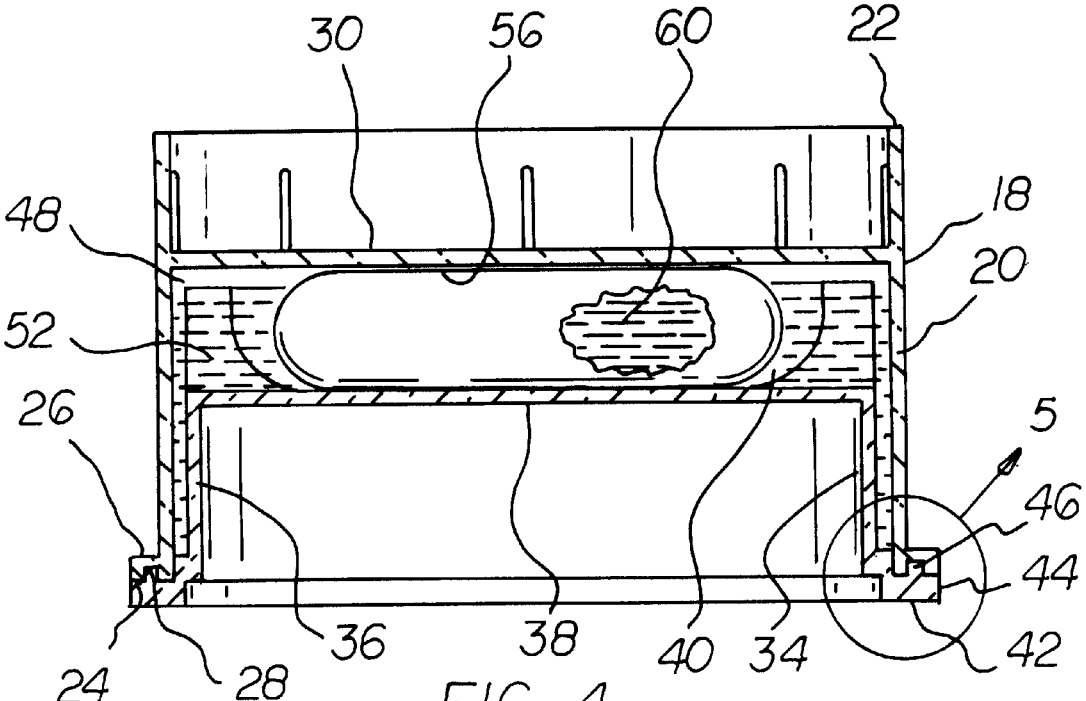
FIG 4

GLOW CUP MODULAR SYSTEM

BACKGROUND OF THE INVENTION

1. Field of the Invention

The present invention relates to a glow cup modular system and more particularly pertains to selectively illuminating a beverage container with an electroluminecent attachment glow cup modular system 2. Description of the Prior Art The use of glowing devices of known makes and models is known in the prior art. More specifically, glowing devices of known makes and models previously devised and utilized for the purpose of illuminating a object through known methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned prior art devices do not describe a glow cup modular system that allows for selectively illuminating a beverage container with an electroluminecent attachment.

In this respect, the a glow cup modular system according to the present invention substantially departs from the conventional concepts and designs of the prior art, and in doing so provides an apparatus primarily developed for the purpose of selectively illuminating a beverage container with an electroluminecent attachment.

Therefore, it can be appreciated that there exists a continuing need for a new and improved a glow cup modular system which can be used for selectively illuminating a beverage container with an electroluminecent attachment. In this regard, the present invention substantially fulfills this need.

SUMMARY OF THE INVENTION

In view of the foregoing disadvantages inherent in the known types of glowing devices of known makes and models now present in the prior art, the present invention provides an improved a glow cup modular system. As such, the general purpose of the present invention, which will be described subsequently in greater detail, is to provide a new and improved glow cup modular system and method which has all the advantages of the prior art and none of the disadvantages.

To attain this, the present invention essentially comprises a beverage container that has a cylindrical base of a predetermined diameter. Secondly the system comprises a relatively rigid exterior member that has a generally cylindrical side wall with a top edge and bottom edge. The side walls slightly tapered inwardly toward the top edge to form an upper cavity for frictionally receiving and retaining the base of the beverage container. A bottom edge has an enlarged horizontal lip extending radially away from its central axis and with downwardly facing annular groove around the lip. The exterior member further has a circular planar surface located at an intermediate height within the cylindrical body to define a lower cavity therebeneath and with the upper cavity thereabove. Thirdly, the system includes a relatively rigid interior member with an axis in common with the vertical central axis. This interior member further has a generally cylindrical side wall with a circumference less than that of the exterior member. It has a planar top surface at the top end and with a generally cylindrical recessed portion extending downward from the center of the planar top and fabricated of a deformable material. The interior member also has a bottom end having a horizontal lip with an upwardly facing annular ridge received by the annular recess of the exterior member. When the interior member is placed within the exterior member to come in contact with each other, an air tight intermediate gap is formed between the planar surface and side wall of the exterior member externally and the top surface and side wall of the interior member internally. Next the system comprises a first chemiluminescent liquid located within the intermediate. Finally the system includes a glass ampule located within the recessed portion of the interior member adapted be broken by a user upon compressing the recess portion. A second chemical luminescent liquid is provided and located within the ampule and adapted to inter mix with the first liquid and fill the intermediate gap upon breaking of the ampule. Also included is a elastermeric sleeve positioned over the lower extent of the container in contact with the exterior member to abate slippage therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glow cup modular system which has all of the advantages of the prior art glowing devices of known makes and models and none of the disadvantages.

It is another object of the present invention to provide a new and improved glow cup modular system which may be easily and efficiently manufactured and marketed.

It is further object of the present invention to provide a new and improved glow cup modular system which is of durable and reliable constructions.

An even further object of the present invention is to provide a new and improved glow cup modular system which is susceptible of a low cost of manufacture with regard to both materials and labor, and which accordingly is then susceptible of low prices of sale to the consuming public, thereby making such glow cup modular system economically available to the buying public.

Lastly, it is an object of the present invention to provide a new and improved glow cup modular system comprising a generally rigid exterior member that has a side wall with a top edge and bottom edge to form an upper cavity for receiving and retaining a beverage container. The exterior member further has a circular planar surface located at an intermediate height. The system also includes a generally rigid interior member that has a side wall with a planar top surface at the top end and has a recessed portion extending downward from the center of the planar top and fabricated of a pliable material. The interior member also has a bottom end having a horizontal lip coupled to the horizontal lip of the exterior member whereby an air tight intermediate gap is formed between the two members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view of the exterior component taken along line 3—3 of FIG. 2.

FIG. 4 is the cross sectional view of the combination of the interior and exterior components coupled for operation and use taken along line 4—4 of FIG. 3.

The same reference numerals refer to the same parts throughout the various Figures.

DESCRIPTION OF THE PREFERRED EMBODIMENT

Figure 1:
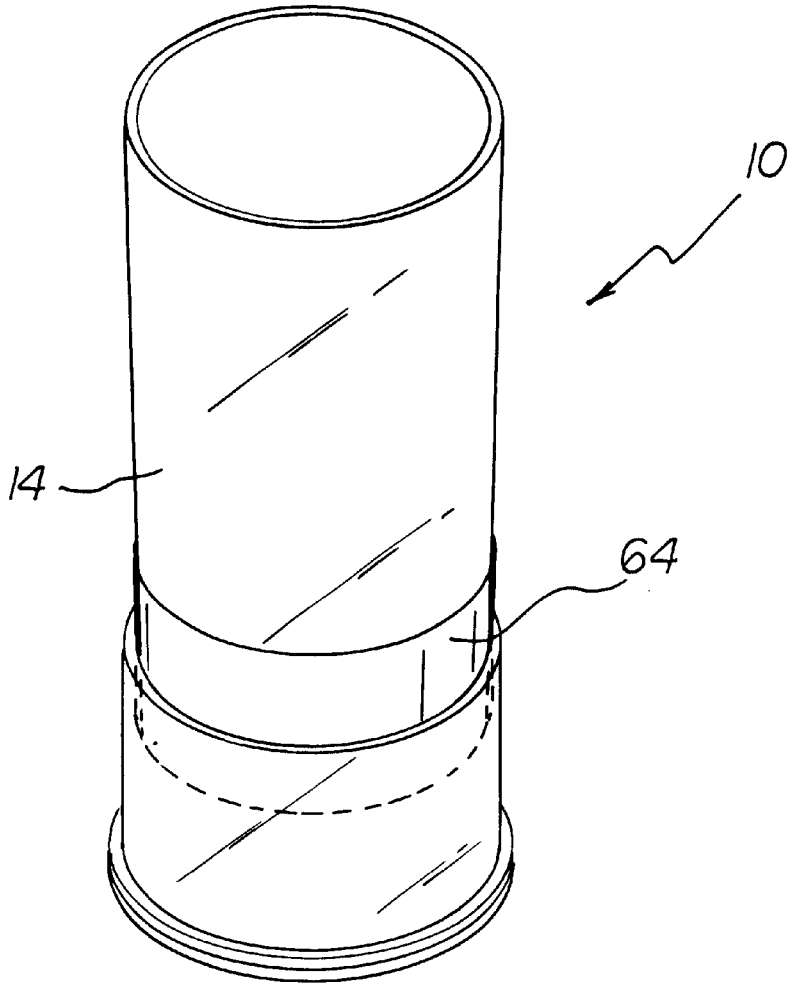
FIG. 1 is perspective illustration of the present invention.
Figure 2:
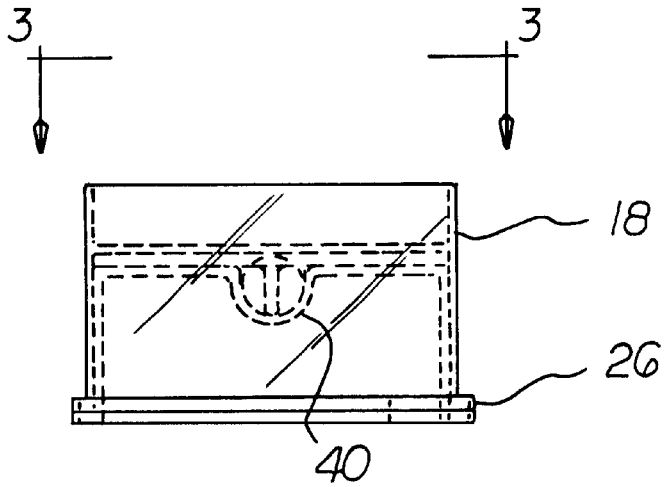
FIG. 2 is a side elevational view of the exterior component of FIG. 1.
Figure 5:
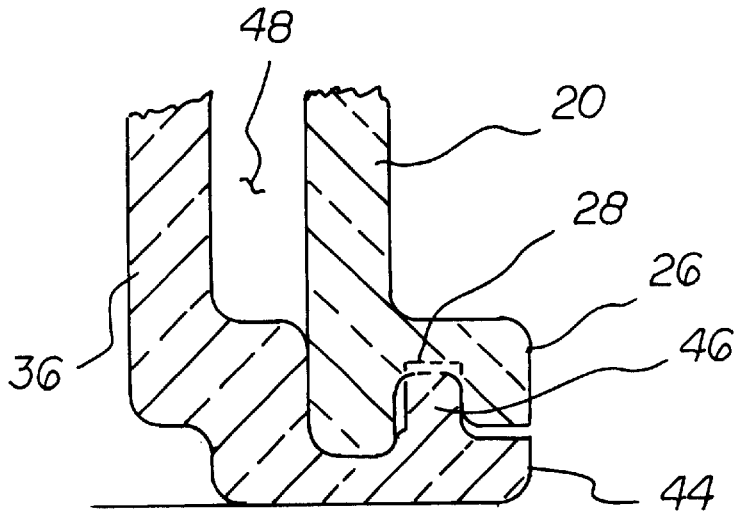
FIG. 5 is an enlarged cross sectional view taken at Circle 5 of FIG. 4.

With reference now to the drawings, and in particular to FIG. 1 thereof, the preferred embodiment of the new and improved glow cup modular system embodying the principles and concepts of the present invention and generally designated by the reference numeral 10 will be described.

The present invention, the glow cup modular system 10 is comprised of a plurality of components. Such components in their broadest context include a beverage container, an interior member, an exterior member, a pair of chemiluminescent liquids and a glass ampule. Such components are individually configured and correlated with respect to each other so as to attain the desired objective.

The system first includes a beverage container 14 that has a cylindrical base of a predetermined diameter. In the primary embodiment, the container is a glass tumbler.

Secondly the system comprises a relatively rigid exterior member 18 with a vertical central axis. Such member has a generally cylindrical side wall 20 with a top edge 22 and bottom edge 24. The side walls slightly taper inwardly toward the top edge to form an upper cavity for frictionally receiving and retaining the base of the beverage container. The diameter of the top of the exterior member is slightly greater than that of the first diameter of the container. A bottom edge 24 has an enlarged horizontal lip 26 extending radially away from its central axis. The lip is formed with a downwardly facing annular groove 28 around the lip. The exterior member further has a circular planar surface 30 located at an intermediate height within the cylindrical body to define a lower cavity there beneath and the upper cavity there above.

Thirdly, the system includes a relatively rigid interior member 34 with an axis in common with the vertical central axis of the exterior member and the container. Furthermore, this interior member has a generally cylindrical side wall 36 with a circumference less than that of the exterior member. It has a planar top surface 38 at the top end. The top surface has a generally cylindrical recessed portion 40 extending downward from the center of the planar top. It is fabricated of a pliable deformable material. The interior member also has a bottom end 42 having a horizontal lip 44 with an upwardly facing annular ridge 46 received by the annular recess of the exterior member. The interior member is then placed within the exterior member to come in contact with each other. The groove of the lip of the exterior member is then globe to the ridge of the interior member for forming an air tight and liquid tight seal. The interior and exterior members thus form an intermediate gap 48 between the planar surface of the interior member and side wall of the exterior member externally and the top surface and side wall of the interior member internally.

The interior and exterior members are preferably fabricated of a plastic material, as for example polyethylene, with a thickness of about 0.060 inches but with the recessed portion having a thickness of about 0.040 inches to provide for its deformation by a user to break an ampule as will be later described.

Next the system comprises a first chemiluminescent liquid 52. Such liquid is located within the intermediate gap between the interior and exterior members.

Next, the system includes a glass ampule 56. The ampule is located within the recessed portion of the interior member. It is adapted to be broken by a user upon compressing the deformable recess portion by pressure from above and below as may be applied by a user.

A second chemiluminescent liquid 60 is located within the ampule. This liquid is adapted to inter mix with the first liquid and fill the intermediate gap upon breaking of the ampule by the user.

The liquids employed are conventional and are described in the patent literature. They include an oxalate and an activator component. Note U.S. Pat. No. 5,597,517 to Chopedekar and U.S. Pat. No. 6,061,380 to Dorney. The subject matter of these patents is included herein by reference.

Finally, an elastomeric sleeve 64 is positioned over the lower extent of the container. It is adapted to contact the exterior member to abate slippage therebetween.

Figure 6:
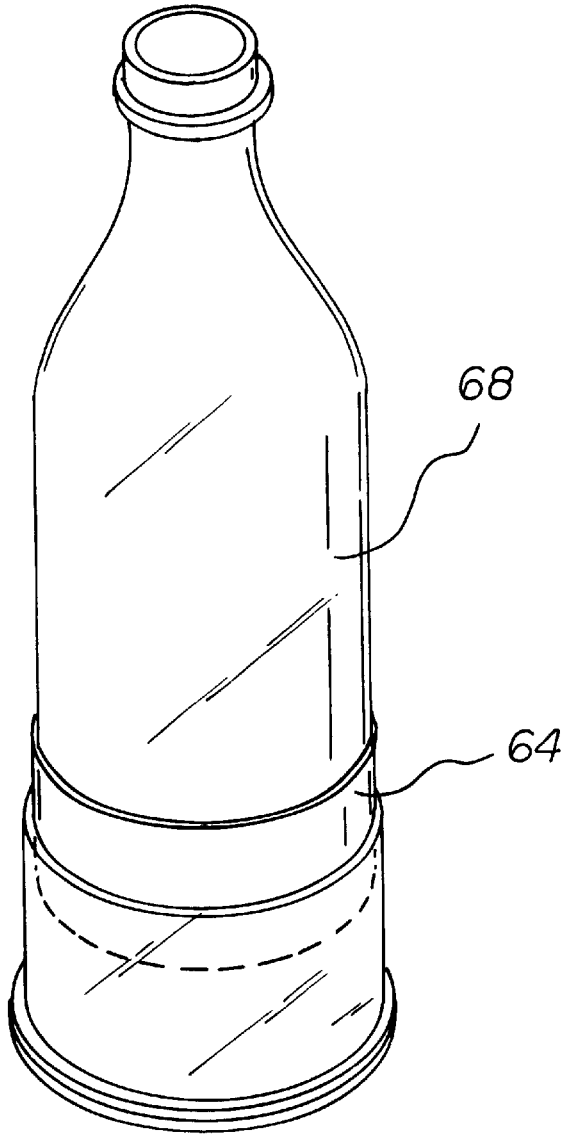
FIG. 6 is a perspective view similar to FIG. 1 but showing an alternate embodiment of the invention.

A second embodiment is shown in FIG. 6. In such embodiment, the container is a bottle 68 rather than the glass tumbler as shown in FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A glow cup modular system for selectively illuminating comprising, in combination;

a beverage container having a cylindrical base of a predetermined first diameter;

a relatively rigid exterior member with a vertical central axis having a generally cylindrical side wall with a top edge and bottom edge and slightly tapering inwardly toward the top edge to form an upper cavity for frictionally receiving and retaining the base of the beverage container, a bottom edge having an enlarged horizontal lip extending radially away from the central axis and with a downwardly facing annular groove around the lip, the exterior member further having a circular planar surface located at an intermediate height within the cylindrical body to define a lower cavity therebeneath and the upper cavity thereabove;

a relatively rigid interior member with an axis in common with the vertical central axis and having a generally cylindrical side wall with a circumference less than that of the exterior member, and with a planar top surface at the top end and also having a generally cylindrical recessed portion extending downward from the center of the planar top fabricated of a deformable material, the interior member also having a bottom end having a horizontal lip with an upwardly facing annular ridge received by the annular recess of the exterior member when the interior member is placed within the exterior member to come in contact with each other to thereby form an air and liquid tight intermediate gap with an upper cylindrical portion between the top surface of the interior member and the bottom surface of the planar surface of the exterior member and a lower annular portion between the side walls of the interior and exterior members;

a first chemiluminescent liquid located within the intermediate gap;

a glass ampule located within the recessed portion of the interior member adapted to be broken by a user upon compressing the pliable recess portion a second chemical luminescent liquid located with in the ampule and adapted to inter mix with the first liquid and fill the intermediate gap upon breaking of the ampule; and an elastomeric sleeve positioned over the lower extent of the container in contact with the exterior member to abate slippage therebetween.

2. A glow cup modular system comprising;

a generally rigid exterior member having a generally cylindrical side wall with a top edge and a bottom edge to form an upper cavity for frictionally receiving and retaining the base of a beverage container, the side wall also having a bottom edge having an enlarged horizontal lip extending radially away from its central axis, the exterior member further having a circular planar surface located at an intermediate height within the cylindrical body to define a lower cavity therebeneath and with the upper cavity thereabove;

a generally rigid interior member having a generally cylindrical side wall with a circumference less than that of the exterior member and with a planar top surface at the top end and having a generally cylindrical recessed portion extending downward from the center of the planar top surface and fabricated of a pliable material, the interior member also having a bottom end having a horizontal lip coupled to the horizontal lip the exterior member when the interior member is placed within the exterior member to come in contact with each other and thereby form an air tight intermediate gap with an upper cylindrical portion between the top surface of the interior member and the bottom surface of the planar surface of the exterior member and a lower annular portion between the side walls of the interior and exterior members.

3. The invention as set forth by claim 2 and further including a chemiluminescent liquid within the gap.

4. The invention as set forth in claim 2 and further including a first chemiluminescent liquid within the gap and a breakable ampule within the recessed portion containing a second chemiluminescent liquid.

5. The invention as set forth in claim 2 and further including a container positionable in the exterior member.

6. The invention as set forth in claim 5 and further including an elastomeric sleeve between the container and the exterior member.

7. The invention as set forth in claim 5 wherein the container is a tumbler.

8. The invention as set forth in claim 5 wherein the container is a bottle.

* * * * *